US010222754B2

(12) United States Patent
Lenoir et al.

(10) Patent No.: US 10,222,754 B2
(45) Date of Patent: Mar. 5, 2019

(54) ANTI-SHOCK DEVICE FOR A TIMEPIECE MOVEMENT

(71) Applicant: Montres Breguet S.A., L'Abbaye (CH)

(72) Inventors: Deirdre Lenoir, Le Sentier (CH); Davide Sarchi, Zurich (CH); Benoit Legeret, Ecublens (CH)

(73) Assignee: Montres Breguet S.A., L'Abbaye (CH)

( * ) Notice: Subject to any disclaimer, the term of this patent is extended or adjusted under 35 U.S.C. 154(b) by 0 days.

(21) Appl. No.: 15/591,209

(22) Filed: May 10, 2017

(65) Prior Publication Data

US 2017/0336761 A1 Nov. 23, 2017

(30) Foreign Application Priority Data

May 18, 2016 (EP) ..... 16170213.9

(51) Int. Cl.
*G04B 29/02* (2006.01)
*G04B 31/02* (2006.01)
*G04B 31/04* (2006.01)

(52) U.S. Cl.
CPC ..... *G04B 31/02* (2013.01); *G04B 29/022* (2013.01); *G04B 31/04* (2013.01)

(58) Field of Classification Search
CPC ..... G04B 31/02; G04B 31/04; G04B 29/022
See application file for complete search history.

(56) References Cited

U.S. PATENT DOCUMENTS 4,308,605 A * 12/1981 Ayer ..... G04B 13/02 368/127
4,409,576 A 10/1983 Petersen
9,606,509 B2 * 3/2017 Marechal ..... F16C 32/0421
2012/0112589 A1 * 5/2012 Marechal ..... F16C 32/0408 310/90.5

(Continued)

FOREIGN PATENT DOCUMENTS

JP 2011-185673 9/2011

OTHER PUBLICATIONS

European Search Report dated Oct. 24, 2016 in European Application 16170213, filed on May 18, 2016 ( with English Translation of Categories of Cited Documents).

*Primary Examiner* — Daniel P Wicklund
(74) *Attorney, Agent, or Firm* — Oblon, McClelland, Maier & Neustadt, L.L.P.

(57) ABSTRACT

The timepiece movement comprises a pivoting element, a bearing for a pivot of this pivoting element and an anti-shock device associated with this bearing and including a resilient member arranged to exert a restoring force on at least one endstone. The anti-shock device further includes a magnetic system comprising two magnets having opposite polarities and a highly magnetically permeable element arranged between these two magnets and secured to one of them, the two magnets being respectively fixed to a support of the anti-shock device and to the resilient member and arranged to produce between them, in association with the highly magnetically permeable element, an overall force of mag- (Continued)

netic attraction on a first section of a possible distance of displacement for the endstone in the event of a shock and an overall force of magnetic repulsion on a second section of this distance of displacement corresponding to greater distances of separation than those of the first section.

11 Claims, 5 Drawing Sheets

(56) References Cited

U.S. PATENT DOCUMENTS

| | | | | |
|---|---|---|---|---|
| 2012/0113767 | A1* | 5/2012 | Marechal | G04B 31/00<br>368/287 |
| 2015/0234361 | A1* | 8/2015 | Marechal | G04C 5/005<br>368/126 |
| 2016/0370762 | A1* | 12/2016 | Zaugg | F16C 32/0412 |
| 2018/0136608 | A1* | 5/2018 | Rochat | G04B 31/02 |

* cited by examiner

ANTI-SHOCK DEVICE FOR A TIMEPIECE MOVEMENT

This application claims priority from European Patent Application No. 16170213.9 filed on May 18, 2016, the entire disclosure of which is hereby incorporated herein by reference.

FIELD OF THE INVENTION

The present invention concerns anti-shock devices for timepieces. Such anti-shock devices are generally associated with bearings which guide in rotation pivoting elements of the timepiece movement, in particular balances. They are also called shock absorbing devices, shock dampers or shock absorbers. The invention more particularly concerns the damping of axial shocks to which pivoting elements are subjected and the mechanical stresses brought to bear on the pivots during such axial shocks.

BACKGROUND OF THE INVENTION

A usual timepiece anti-shock device includes a resilient member which bears on or which exerts a pressure against at least one endstone of the bearing comprising the anti-shock device, the endstone forming a stop for the pivot inserted into the bearing in the direction of the axis of rotation of the pivoting element concerned. This anti-shock device is arranged to be able to generate, through the endstone, a restoring force on the pivot in question, when the pivot presses against the endstone in the event of a shock. It is understood that "endstone" means any structure, made of any suitable material, which defines an axial bearing surface for the pivot.

Such anti-shock devices generally include mechanical springs which are dimensioned empirically, according to practical rules, such as that of the best compromise between mechanical stability in operation and elastic resistance to mechanical deformations. Indeed, it is desirable to have a relatively stiff shock absorber which does not cause axial movements of the pivoting element with each small shock, while ensuring the shock absorber function for violent shocks causing high axial (positive or negative) accelerations for the pivoting element which could damage its pivots.

In particular, conventional anti-shock devices for the sprung balance, "parachutes" and lyre-springs, are dimensioned such that they are only actuated upon relatively high shock accelerations (between 200 g and 500 g, g being the earth's acceleration), as a result of the prestress of the spring forming these "parachutes" and lyre-springs, which defines a threshold value. Beyond this threshold value, it is provided that the spring deforms and absorbs part of the shock energy. However, because of the low mechanical shock absorption of the metallic strips used, most of the energy is restored to the balance. Local deformation of the balance pivot is thus highly probable, even for relatively low shocks. Such a deformation, which has a considerable impact on the chronometric precision of the watch, is generally ignored because the certified chronometer standard for the chronometric stability of a watch following a one meter shock is not strict (difference of 60 seconds/day).

SUMMARY OF THE INVENTION

It is an object of the present invention to provide a timepiece movement equipped with at least one effective anti-shock device which provides a solution to the problem of damage to the pivots if shocks occur, even in the event of strong shocks.

To this end, the present invention concerns a timepiece movement as defined in claim 1.

As a result of the features of the invention, which will be described in detail hereinafter, the anti-shock device presents less resistance for relatively strong shocks while ensuring good stability for smaller shocks. Indeed, the stiffness of the anti-shock device according to the invention means it no longer behaves like a mechanical spring that produces a restoring force substantially proportional to the axial displacement of the endstone. On the contrary, it exerts a relatively high force when the displacement is zero, which then diminishes over at least the initial part of the shock damping travel that can be made by the endstone.

In a main embodiment, the first and second magnets and the highly magnetically permeable element are aligned in a direction substantially parallel to the axis of rotation of the pivoting element, the first and second magnets having opposite polarities in this direction.

In a preferred variant, the highly magnetically permeable element is fixed to the first magnet.

BRIEF DESCRIPTION OF THE DRAWINGS

The invention will be described below with reference to the annexed drawings, given by way of non-limiting example, and in which.

DETAILED DESCRIPTION OF THE INVENTION

Figure 1:
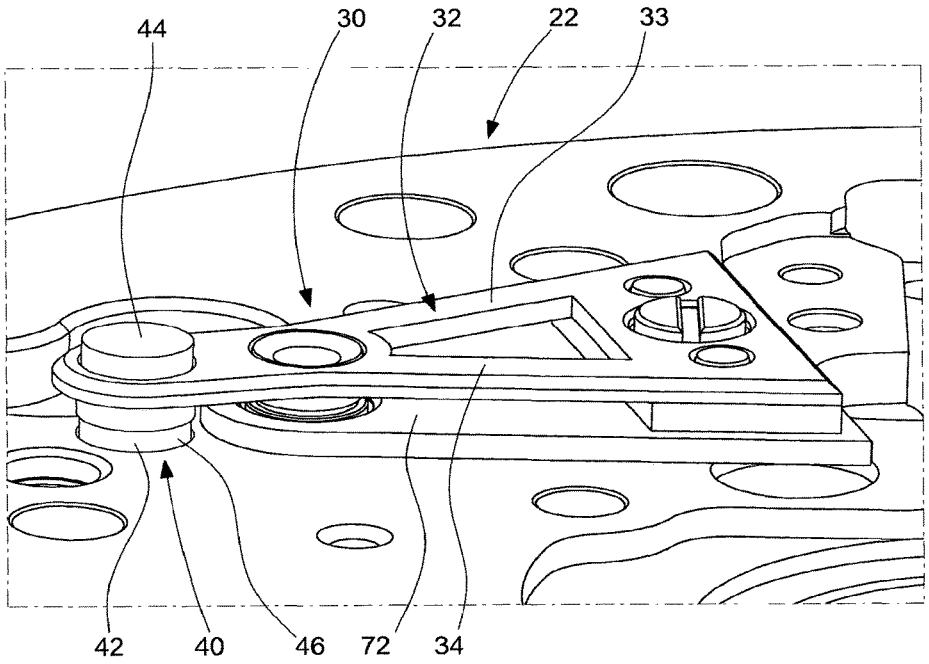
FIG. 1 is a perspective, bottom view of an anti-shock device according to a first embodiment of the invention.

With reference to FIGS. 1 to 5, there will be described below a first embodiment of a timepiece movement 22 incorporating a pivoting element 24, a bearing 28 in which is arranged a pivot 26 of the pivoting element and an anti-shock device 30 associated with the bearing.

Generally, anti-shock device 30 includes a resilient member 32 that exerts a force on an endstone 36, which forms a stop for pivot 26 in the direction of the axis of rotation of the pivoting element. This anti-shock device is arranged to be able to generate, through the endstone, a restoring force on pivot 26 when the pivot presses against the endstone in the event of a shock. According to the invention, the anti-shock device further includes a magnetic system 40 comprising two magnets 42, 44, and a highly magnetically permeable element 46 arranged between these two magnets and secured to one of them. These two magnets are respectively secured to a support 48 of the anti-shock device and to resilient member 32, in order to present between them a relative movement over a certain relative distance D (referenced in FIG. 3) when the resilient member is momentarily subjected, especially when a certain shock occurs, to an elastic deformation under a certain pressure exerted by the pivot against the endstone. More particularly, magnet 44, integral with the resilient member, is arranged to be subjected, in the event of relatively strong axial shocks on the pivoting element, to a back-and-forth motion, symbolised in FIG. 2 by a two-way arrow. In the absence of a shock, the resilient member is in a determined rest position, as is the magnet that carries it. It will be noted that, in this rest position, the resilient member may present an initial elastic deformation. In this latter case, the resilient member is said to be prestressed.

In a remarkable and very advantageous manner, as will be explained below with reference to FIGS. 3 and 4, the two magnets 42 and 44 are arranged to generate between them, in association with the highly magnetically permeable element 46, an overall force of magnetic attraction in a first section of the aforementioned relative distance, and an overall force of magnetic repulsion on a second section of this relative distance, the second section corresponding to distances of separation (referenced E in FIG. 3) between the first and second magnets which are greater than the distances of separation corresponding to the first section. Further, magnetic system 40 and resilient member 32 are arranged such that the total force exerted in the event of a shock by the anti-shock device on pivot 26 remains a restoring force for the whole of the relative distance.

Figure 2:
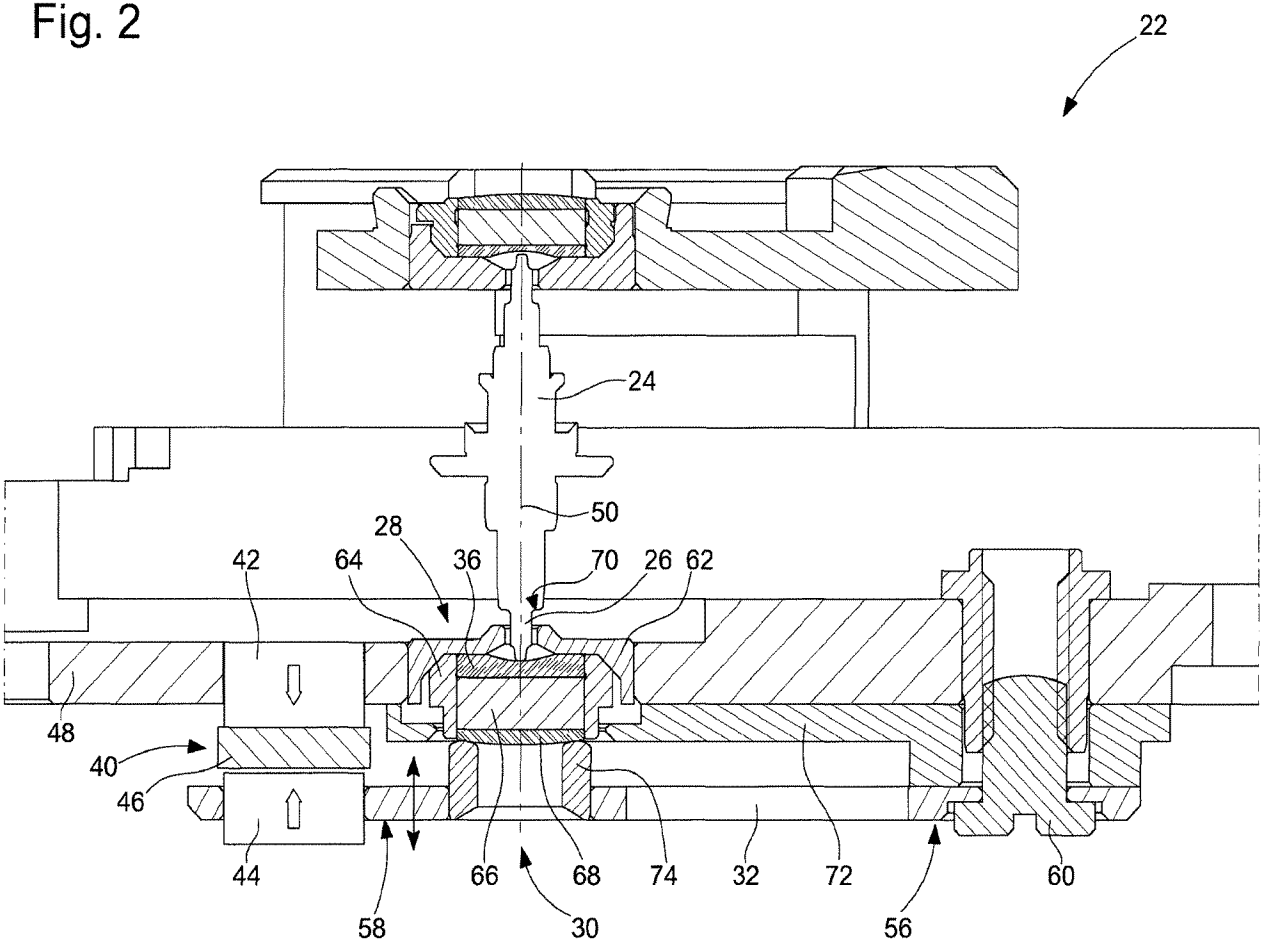
FIG. 2 is a partial cross-sectional view of a timepiece movement incorporating the anti-shock device of FIG. 1, taken through the anti-shock device.

Particular variants of the first embodiment, all represented in FIG. 2, are as follows:

- The highly magnetically permeable element 46 is fixed to magnet 42 integral with support 48;
- The highly magnetically permeable element consists of a plate having a central axis that is substantially coincident with the axis of magnetization of magnet 42;
- When the resilient member is in its rest position, the two magnets 42, 44 and the highly magnetically permeable magnet 46 are aligned in a direction substantially parallel to the axis of rotation 50 of pivoting element 24;
- Magnets 42 and 44 have opposite polarities along their direction of alignment.

In particular, according to the variant shown in FIGS. 1 and 2, the two magnets are cylindrical and the plate is in the form of a disc made, for example, of a ferromagnetic material.

Figure 3:
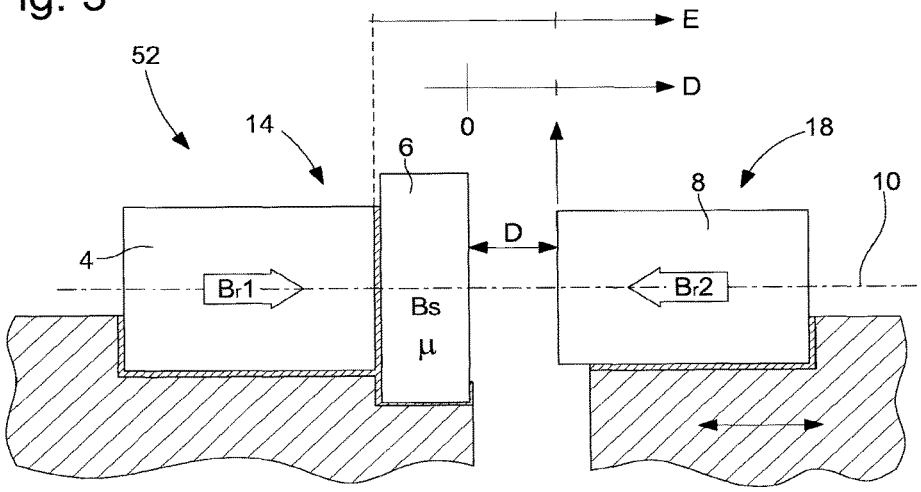
FIG. 3 is a side view, partially in cross-section, of a magnetic system similar to that incorporated in the anti-shock device of the invention.
Figure 4:
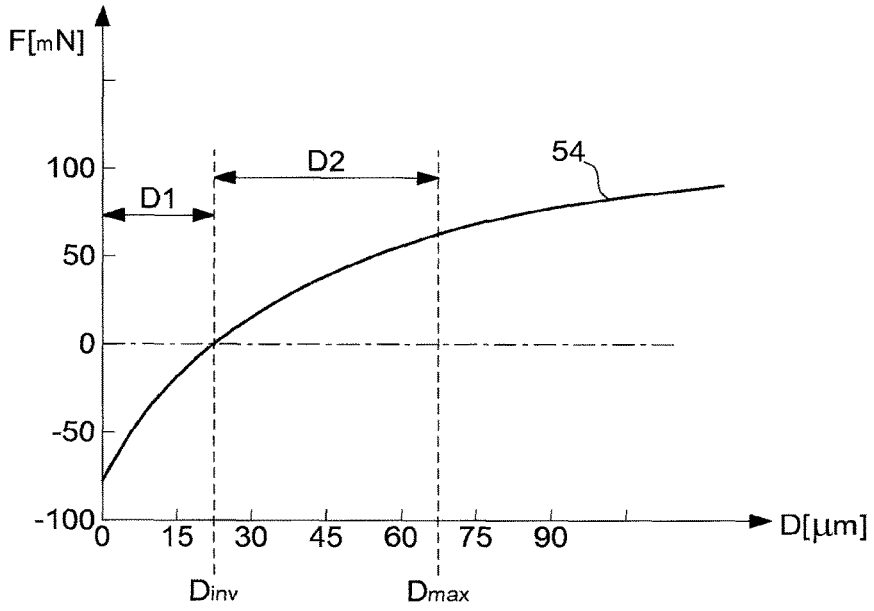
FIG. 4 shows the graph of the overall magnetic force exerted on a movable magnet according to its distance from a ferromagnetic disc for the magnetic system of FIG. 3.

Referring to FIGS. 3 and 4, magnetic system 40 and the operation thereof will be described below. To this end, FIG. 3 represents a magnetic system 52 similar to magnetic system 40. Thus, magnetic system 52 includes a first magnet 4, a highly magnetically permeable element 6, which is integral with the first magnet, and a second magnet 8 which is movable, along an axis of displacement, relative to the assembly formed by first magnet 4 and element 6. As indicated above, element 6 is arranged between the first magnet and the second magnet, in contact with or close to the first magnet. In particular, element 6 is bonded to the first magnet, as shown in FIG. 3. In another variant, the first magnet can be pressed into the highly magnetically permeable element, which in that case takes the form, for example, of a cylindrical case open at one end to receive the first magnet. In a preferred variant, the distance between element 6 and the magnet 4 integral therewith is less than or substantially equal to one tenth of the length of the magnet along its axis of magnetisation. First magnet 4 and element 6 form a first part of the magnetic system and second magnet 8 forms a second part of this system. Element 6 consists, for example, of a carbon steel, tungsten carbide, nickel, FeSi or FeNi, or other alloys with cobalt such as Vacozet® (CoFeNi) or Vacoflux® (CoFe). In an advantageous variant, this highly magnetically permeable element consists of an iron or cobalt-based metallic glass. Element 6 is characterized by a saturation field $B_S$ and a permeability μ. Magnets 4 and 8 are, for example, made of ferrite, FeCo or PtCo, rare earths such as NdFeB or SmCo. These magnets are characterized by their remanent field Br1 and Br2.

Highly magnetically permeable element 6 has a central axis 10 which is substantially coincident with the axis of magnetisation of first magnet 4 and also with the axis of magnetisation of second magnet 8. The respective directions of magnetisation of magnets 4 and 8 are opposite. These first and second magnets thus have opposite polarities and they are capable of being subjected between them to a relative motion over a certain relative distance D. In the example represented in FIG. 3, magnet 4 is fixed and magnet 8 is movable, so that the direction of the relative motion between them is substantially along central axis 10, which thus defines the axis of displacement. It will be noted that axis 10 is linear, but this is a non-limiting variant. Within the first embodiment of the invention, the axis of displacement is substantially in the arc of a circle, the central axis of element 46 being substantially tangent to this curved axis of displacement. In such case, in first approximation, the behaviour of magnetic system 40 is similar to that of magnetic system 52. This is all the more so if the radius of curvature is large relative to the maximum possible distance between element 46 and magnet 44, as is the case in the first embodiment of the invention. In a preferred variant, as represented in FIG. 3, element 6 has dimensions in an orthogonal plane to central axis 10 which are greater than those of first magnet 4 and than those of second magnet 8 in projection into this orthogonal plane. It will be noted that, in the case where the second magnet moves into abutment against element 6 at the end of the magnetic attraction travel, the second magnet advantageously has a hardened surface or a fine layer of hard material at its surface.

The two magnets 4 and 8 are arranged in magnetic repulsion such that, in the absence of highly magnetically permeable element 6, a force of repulsion tends to moves these two magnets away from each other.

However, surprisingly, the arrangement between these two magnets of element 6 reverses the direction of the magnetic force between the first and second parts of the magnetic system when they are at a short distance from each other, such that an overall force of magnetic attraction is then produced between these two parts. FIG. 4 is a graph whose curve 54 represents the force of magnetic interaction between the first and second parts of magnetic system 52 according to the distance of separation E between the two magnets, respectively to the relative distance D between movable magnet 8 and highly magnetically permeable element 6. It is observed that magnet 8 is subjected overall, on a first section D1 of the relative distance, to a force of magnetic attraction which tends to hold magnet 8 against element 6, or to return it towards the latter if they are moved apart. Next, element 6 and the two magnets are arranged such that second magnet 8 is subjected overall, on a second section D2 of the aforementioned relative distance, to a force of magnetic repulsion. This second section corresponds to distances of separation between the first and second parts, and thus to distances D between element 6 and magnet 8, which are greater than the distances of separation corresponding to the first section of the relative distance. The second section is limited by a maximum distance $D_{max}$ which is generally defined by a stop limiting the distance of separation of the movable magnet.

The overall magnetic force is a continuous function of the distance between the components and it has a zero value at distance $D_{inv}$. Thus, when the distance between magnet 8 and element 6 is greater than a distance $D_{inv}$, this magnet is subjected to an overall force of magnetic repulsion which tends to move element 6 away. However, when the distance between element 6 and movable magnet 8 is less than distance $D_{inv}$, magnet 8 is subjected to an overall force of magnetic attraction which tends to move it closer to element 6 and, if there is no resistance, to place it in contact with element 6 and then hold it in this position. This is a characteristic function of magnetic system 52 which is put to good use in the anti-shock device according to the invention. The reversal distance $D_{inv}$, is determined by the geometry of the three magnetic components forming the magnetic system and by their magnetic properties.

Below will be described in more detail the anti-shock device 30 according to the first embodiment and its behaviour resulting from the incorporation, according to the invention, of magnetic system 40. Resilient member 32 is formed by a flat spring having a first end 56 and a second end 58, the first end being fixed to support 48 by means of a screw 60 and the second end carrying second magnet 44. According to an advantageous variant, endstone 36 is located, in projection into a general plane of the flat spring, between the first and second ends. Bearing 28 comprises a base 62, fixedly arranged inside an opening in support 48. In a conventional manner, this base has at its centre a hole into which pivot 26 passes. Pivoting element 24, which is the balance staff here (not represented), has a bearing surface 70 which limits the displacement of the element along axis 50 in a conventional manner, this bearing surface moving into abutment against a surface defined by the base at the periphery of the hole. Bearing 28 also includes a setting 64 into which endstone 36 is inserted. In the variant represented, this is a magnetic bearing. Thus, the setting also carries a magnet 66 and a closing jewel 68. This setting is also part of the anti-shock device. It is arranged inside a housing formed by base 62 and a closing plate 72 fixed to support 48, in order to be subjected to an axial movement at least on a distance corresponding to the maximum displacement to which pivot 26 can be subjected in the event of a shock when bearing surface 70 moves into abutment against the base. A short pipe 74 is fixed to flat spring 32 on the side of its end 58 in order to rest against the setting or the closing jewel. The anti-shock device acts on the assembly integral with the endstone via this pipe. It will be noted that the invention is not limited to a magnetic bearing. Thus, in another variant, there is a conventional bearing with a setting incorporating a jewel hole and an endstone, with the latter able to have a flat surface facing the pivot.

The magnetic system and the resilient element are arranged such that, in a rest position of the anti-shock device, the endstone, or a setting to which it is fixed, is held resting against the bearing support or against a base of the bearing while the force exerted by the pivot concerned against the endstone is less than a limit value, the latter preferably being higher than the gravitational force acting on the pivoting element, notably the sprung balance. In a particular variant, the resilient element is prestressed in the rest position of the anti-shock device, so that the endstone remains immobile over a larger range of values of the force exerted by the mobile element subjected to an axial acceleration in the event of a shock.

Figure 5:
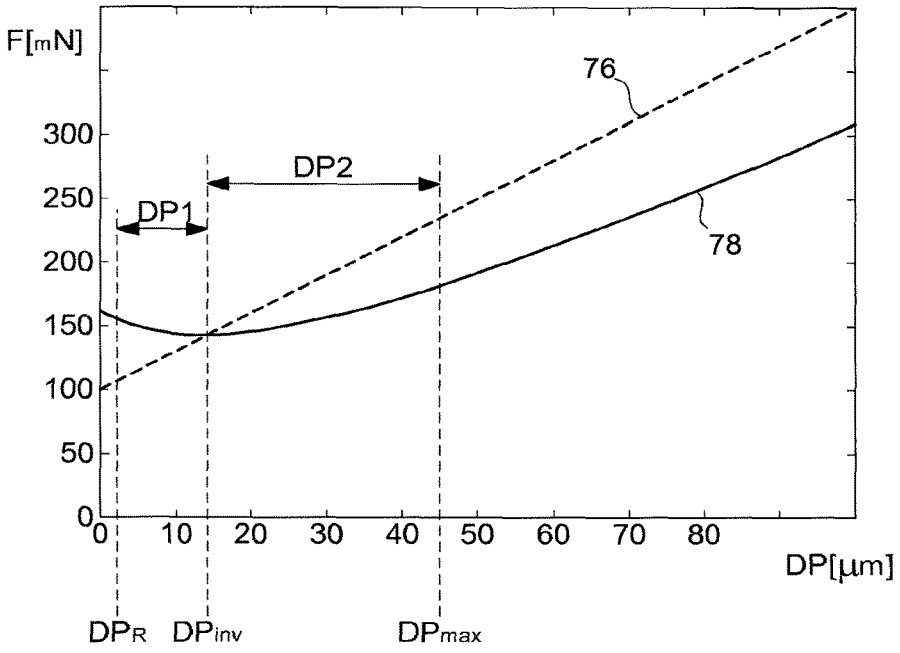
FIG. 5 shows the graph of the elastic force exerted by the flat spring of the anti-shock device of FIG. 1 on the pivot of a pivoting element, and the graph of the total force exerted by the anti-shock device according to the displacement of this pivot, bearing against an endstone, along its axis of rotation.

FIG. 5 represents the graph of the elastic force exerted by flat spring 32 and the graph of the total force exerted by anti-shock device 30 according to the displacement DP of the endstone and thus of pivot 26, resting against this endstone, along its axis of rotation 50. It will be noted that there is a linear relation (in first approximation) between displacement DP and distance D of magnetic system 40 described above. In a known manner, the elastic force varies proportionally with displacement DP. The graph thereof is an affine line 76 shown in a dotted line. The graph of the total force exerted by the anti-shock device on the assembly carrying the endstone, and thereby on pivot 26 resting against this endstone, according to its displacement DP is provided by curve 78, which corresponds to the sum of the elastic force and of the overall magnetic force produced by magnetic system 40. It is observed that this total force (restoring force) is greater than the elastic force on a first section DP1 between a distance $DP_R$, corresponding to the rest position of the anti-shock device, and a distance $DP_{inv}$ corresponding to a position of the endstone in which the overall magnetic force exerted on magnet 44 is zero. Next, between distance $DP_{inv}$ and distance $DP_{max}$, at which balance staff 24 is stopped against the peripheral surface of the hole in the base of the bearing, the total force is less than the elastic force, since the overall magnetic force then resists the elastic force, which decreases the total force exerted on the pivot of the pivoting element.

The anti-shock device according to the invention exhibits remarkable behaviour, as represented by curve 78. The force exerted on the pivot resting against the endstone, at least for a displacement distance of the endstone less than $DP_{inv}$, is maximum for the distance at rest $DP_R$ of the anti-shock device. As soon as the force applied by the pivot to the endstone rises above the maximum value for the rest position of the anti-shock device, the endstone moves away from its rest position and then the total force which is exerted against pivot 26 decreases relatively rapidly, which immediately ensures a relatively large movement of the endstone and good shock damping to the stop position. In the example given in FIG. 5, the flat spring has a stiffness close to a standard stiffness but its prestress is reduced, compared to a standard prestress, by a factor of around 30% to 40%, while providing standard stability for the anti-shock device in its rest position.

The dependency of the total force on the pivot according to the axial displacement of the balance and to the corresponding displacement of the anti-shock device allows for the following operation (for a variant with a balance having a weight of around 40 mg and an element made of ferromagnetic material between the two magnets of the magnetic system):

1) For an acceleration shock of less than 400 g, the anti-shock device remains immobile as a result of the force of magnetic attraction and the prestress of the spring which are summed.
2) For a shock that exceeds 400 g, in particular of 1,000 g, the movable magnet carried by the spring detaches from the ferromagnetic element and the magnetic force rapidly decreases and is then reversed, in that case resisting the elastic force applied by the spring. Once the axial movement activation threshold force of the anti-shock device has been exceeded, the total resulting force decreases at least over most of the possible displacement for the pivot, since the deformation of the anti-shock device immediately becomes very significant and allows the balance to very quickly reach a mechanical stop. This allows the kinetic energy of the balance to be absorbed while limiting the force applied to the pivot over the entire shock damping travel.

Once the shock has ended, the anti-shock device can return to its initial position, since the total force remains positive (restoring force) and exceeds the friction forces. The magnetic force reversal, which occurs when the movable magnet moves sufficiently close to the ferromagnetic element, simultaneously ensures the complete absence of mechanical hysteresis and the recentring of the bearing after a shock.

The following advantages result from the features of the anti-shock device according to the invention:

The anti-shock device operates like a true shock absorber (unlike conventional anti-shock devices);

Possibility of dimensioning the anti-shock device by optimising the prestress (and thereby operation for small shocks where bearing stability is desired) and the damping response for large shocks;

After a large shock, repositioning of the anti-shock device in its given rest position and recentring of the setting (defining the axis of rotation of the balance) ensured by the force of magnetic attraction;

The force to which the balance pivot is subjected in the event of a large shock is reduced, as the maximum force is preferably the total force of the anti-shock device occurring in its rest position.

Figure 6:
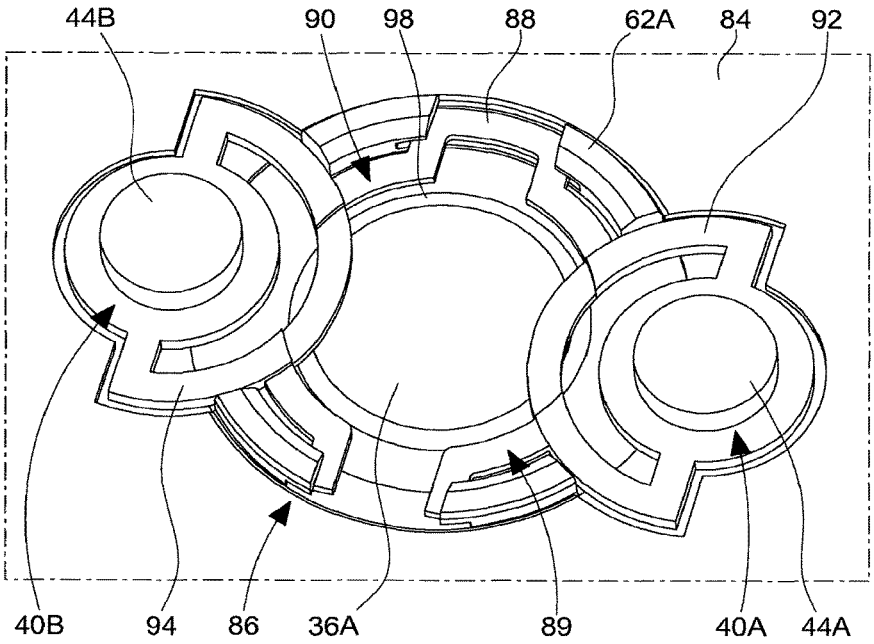
FIG. 6 is a top view of an anti-shock device according to a second embodiment of the invention.
Figure 8:
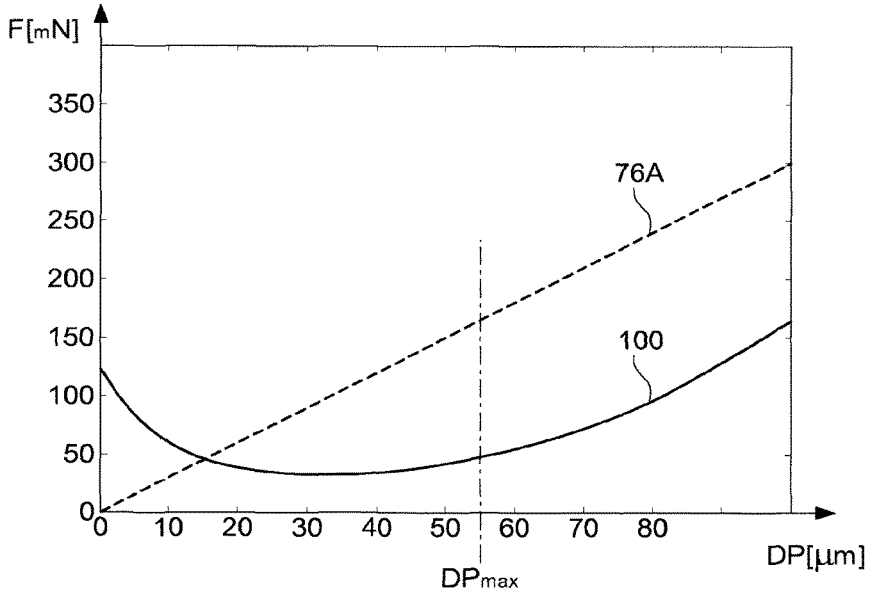
FIG. 8 shows the graph of the elastic force exerted by the lyre spring of the anti-shock device of FIGS. 6 and 7, on the pivot of a pivoting element and the graph of the total force exerted by the anti-shock device according to the displacement of this pivot, bearing against an endstone along its axis of rotation.
Figure 7:
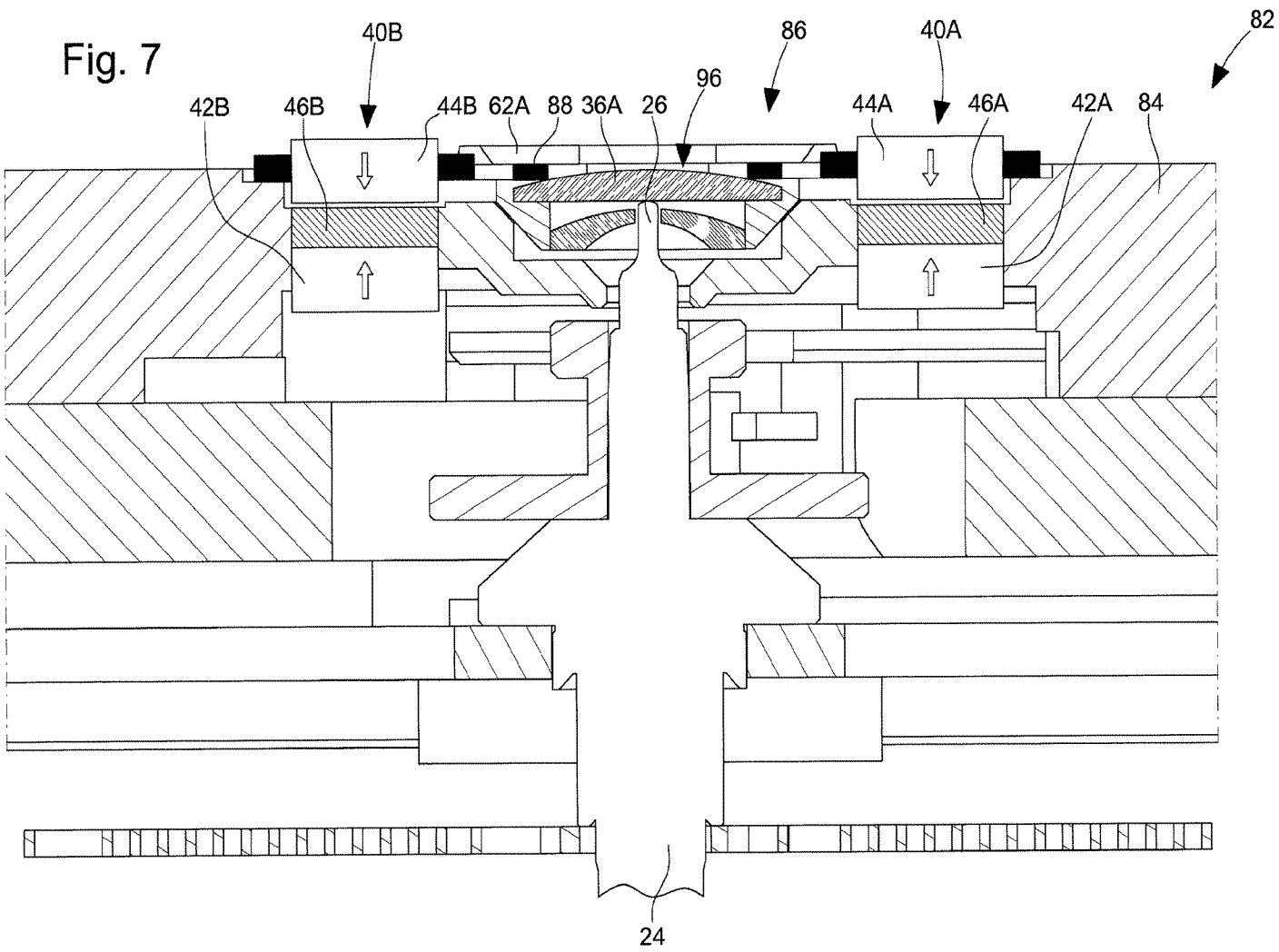
FIG. 7 is a partial cross-sectional view of a timepiece movement incorporating the anti-shock device of FIG. 6, taken through the anti-shock device.

Referring to FIGS. 6 to 8, there will be described below a timepiece movement 82 incorporating a second embodiment of an anti-shock device according to the invention. The bearing and anti-shock device 86 which is associated therewith are arranged inside an opening in a plate 84. The resilient member 88 is a lyre-spring having two branches 89 and 90 arranged to exert a pressure on endstone 36A. In a variant (not represented), the two branches press on a setting to which this endstone is fixed. The anti-shock device includes a first magnetic system 40A and a second magnetic system 40B each similar to the magnetic system 40 described in relation to the first embodiment. Thus, the remarkable operation of these two magnetic systems will not be described again here.

The two magnetic systems are respectively associated with two structures 92 and 94, which are respectively fixed to the two branches 89 and 90 substantially in their median area. These two structures respectively carry two magnets 44A and 44B each forming the movable magnet of the respective magnetic system. Thus, the two branches are respectively associated with the first and second magnetic systems and each carry, via structures 92 and 94, a movable magnet 44A, respectively 44B, which cooperates with a fixed magnet 42A, respectively 42B. Each magnetic system further includes a highly magnetically permeable element 46A, respectively 46B, which is integral with the fixed magnet of the respective magnetic system.

It will be noted that each of branches 89, 90 of the lyre-spring, is axially retained, in a conventional manner, at its two ends by angularly projecting portions of an upper ring of base 62A of the bearing. Thus, it is in the median area of these branches that the lyre-spring, when stressed, is subjected to a maximum elastic deformation. It will also be noted that each branch presses substantially in the middle thereof onto the endstone. Preferably, but in a non-limiting manner, the two structures 92 and 94 are integral with the lyre-spring and have a greater stiffness than that of the respective branches, in particular through a greater thickness, as represented in the Figures. However, in another variant, the structures have the same thickness as the lyre-spring branches, to facilitate fabrication, but have larger cross-sections. However, in another variant, the stiffness of the movable magnet carrier structures is not greater than that of the branches, as the movable magnets make longer travels, in the event of large shocks, than the endstone.

The arrangement of the two magnetic systems associated in a symmetrical manner respectively with the two resilient lyre-spring branches is advantageous, since this arrangement results in the same pressure from each branch on the endstone, or more generally, on the movable bearing assembly 96, for the same elastic deformation of the two branches. Uniform behaviour of the anti-shock device, and in particular endstone 36A, is thus maintained in a general plane perpendicular to the axis of rotation of the balance in the event of axial shocks.

FIG. 8 shows the curve 76A of the elastic force applied by the lyre-spring to the endstone, and thus on pivot 26 resting against the latter, as a function of the axial displacement of the endstone, and the curve 100 of the total force exerted by anti-shock device 86 on the pivot as a function of said axial displacement. It will be noted that the variant represented is particular in no mechanical prestress of the anti-shock device is provided in the rest position; it is only the force of magnetic attraction that ensures the immobility of the anti-shock device in its static operating range (rest position corresponding here to a displacement DP equal to zero) to a certain maximum static force of this anti-shock device. The preponderance of magnetic force in the rest position makes it possible for the total force to drop well below the maximum force of the static situation as soon as the anti-shock device enters its dynamic operating range and as soon as it is therefore cocked. This makes it possible to ensure that the maximum force applied to the pivot, resting against the endstone, is that of the anti-shock device in the non-cocked state. Thus, upon an abrupt movement of the pivot due to a large axial shock, the balance shifts, subjected to less resistance until it encounters the stop formed by the base of the bearing. It will be noted that this stop, by acting on an annular bearing surface of balance staff 24, can protect the balance pivot in the event of violent shocks.

Finally, the stiffness of the lyre-spring and the dimensioning of the two magnetic systems are provided so that the total resulting force applied by the anti-shock device remains a restoring force higher than the friction forces, to ensure, after a shock producing a force higher than the maximum force occurring in the static situation on movable bearing assembly 96, the return of the anti-shock device to its initial position and proper recentring of this movable assembly (a crucial property for ensuring good chronometry of the timepiece movement).

It will be noted that, advantageously in the second embodiment, the two bearings of a sprung balance are equipped with a shock absorber device of the type described above.

What is claimed is:

1. A timepiece movement comprising:

a pivoting element;

a bearing in which is arranged a pivot of the pivoting element; and an anti-shock device associated with the bearing, the anti-shock device comprising a resilient member to exert a pressure on at least one endstone forming a stop for said pivot in a direction of an axis of rotation of the pivoting element, the anti-shock device generating, through the endstone, a restoring force on said pivot when the pivot presses, in an event of a shock, against the endstone, wherein the anti-shock device further includes a magnetic system comprising a first magnet, a second magnet and a highly magnetically permeable element arranged between the first and second magnets and integral with one of the first and second magnets, the first and second magnets being respectively secured to a support of the anti-shock device and to the resilient member, in order to present between them a relative movement over a certain relative distance when the resilient member is subjected, in the event of the shock, to an elastic deformation under a pressure exerted by said pivot against said endstone, wherein the first and second magnets are to generate between them, in association with said highly magnetically permeable element, an overall force of magnetic attraction in a first section of said relative distance and an overall force of magnetic repulsion on a second section of the relative distance, the second section corresponding to distances of separation between the first and second magnets which are greater than the distances of separation corresponding to the first section, and wherein said magnetic system and said resilient member are arranged such that a total force exerted by the anti-shock device on said pivot in the event of the shock remains as the restoring force for a whole of said relative distance.

2. The timepiece movement according to claim 1, wherein the first and second magnets and said highly magnetically permeable element are aligned in a direction substantially parallel to the axis of rotation of said pivoting element, the first and second magnets having opposite polarities in the direction substantially parallel to the axis of rotation of said pivoting element.

3. The timepiece movement according to claim 2, wherein said highly magnetically permeable element includes a plate having a central axis that is substantially coincident with an axis of magnetization of the first magnet.

4. The timepiece movement according to claim 2, wherein a distance between the highly magnetically permeable element and the magnet integral with the highly magnetically permeable element is less than or substantially equal to one tenth of a length of the integral magnet along its axis of magnetization.

5. The timepiece movement according to claim 1, wherein said highly magnetically permeable element is fixed to the first magnet.

6. The timepiece movement according to claim 5, wherein the magnetic system and the resilient member are arranged such that, in a rest position of the anti-shock device, the resilient member holds the endstone, or a setting to which the endstone is fixed, resting against said support or against a base integral with the support while a force exerted by said pivot against the endstone is less than a limit value, the limit value being higher than a gravitational force acting on said pivoting element.

7. The timepiece movement according to claim 6, wherein said resilient member is prestressed in said rest position of said anti-shock device.

8. The timepiece movement according to claim 1, wherein the highly magnetically permeable element is formed of an iron or cobalt based metallic glass.

9. The timepiece movement according to claim 1, wherein said resilient member is a flat spring having a first end and a second end, the first end being fixed to said support and the second end carrying the second magnet, said endstone being situated, in projection in a general plane of the flat spring, between the first and second ends.

10. The timepiece movement according to claim 1, wherein said resilient member is a lyre-spring having two branches arranged to exert a pressure on the endstone or on the setting to which said endstone is fixed, said magnetic system defines a first magnetic system and the anti-shock device further includes a second magnetic system including a first magnet and a second magnet, said two branches being respectively associated with the first and second magnetic systems and each carrying the second magnet of the respective first and second magnetic systems, which cooperates with the first magnet of the respective first and second magnetic systems, fixed to said support of the anti-shock device.

11. The timepiece movement according to claim 1, wherein said pivoting element is a balance.

* * * * *